US011370235B2

(12) United States Patent
Mizutani

(10) Patent No.: US 11,370,235 B2
(45) Date of Patent: Jun. 28, 2022

(54) PRINTER CONFIGURED TO SET OPERATION MODE TO ONE OF FIRST MODE AND SECOND MODE FOR APPROPRIATELY DETERMINING WHETHER TO ALLOW SUBSEQUENT PRINT CONTROL

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 140 days.

(21) Appl. No.: 16/816,554

(22) Filed: Mar. 12, 2020

(65) Prior Publication Data

US 2020/0290377 A1 Sep. 17, 2020

(30) Foreign Application Priority Data

Mar. 14, 2019 (JP) ..... JP2019-046681

(51) Int. Cl.
*B41J 11/66* (2006.01)
*B41J 11/70* (2006.01)
(Continued)

(52) U.S. Cl.
CPC ..... *B41J 11/703* (2013.01); *B41J 11/009* (2013.01); *B41J 11/0095* (2013.01);
(Continued)

(58) Field of Classification Search
CPC ..... B41J 11/009; B41J 11/0095; B41J 11/663; B41J 11/703; B41J 13/0036; B65H 35/06; B65H 43/02
See application file for complete search history.

(56) References Cited

U.S. PATENT DOCUMENTS 5,639,169 A * 6/1997 Aruga ..... B41J 2/30 400/605
6,633,740 B2 * 10/2003 Estabrooks ..... B65H 35/04 399/385

(Continued)

FOREIGN PATENT DOCUMENTS

JP H07-214876 A 8/1995
JP 4566816 B2 10/2010

(Continued)

*Primary Examiner* — Jill E Culler
(74) *Attorney, Agent, or Firm* — Kenealy Vaidya LLP

(57) ABSTRACT

A printer includes: a printing head; a conveyor; a cutter for cutting the medium to provide a segmented medium; a discharge roller; a counter roller; a sensor for detecting whether the segmented medium remains between the discharge roller and the counter roller; and a controller configured to perform: setting an operation mode to one of a first mode and a second mode depending on a medium kind; controlling the printing head and the conveyor to perform a first print control on the medium; controlling the sensor to detect whether the segmented medium has been removed; and permitting a second print control to be performed. When the operation mode is the first mode, the second print control is permitted after the sensor detects whether the segmented medium has been removed. When the operation mode is the first mode, the second print control is permitted without controlling the sensor.

9 Claims, 9 Drawing Sheets

(51) Int. Cl.

| | |
|---|---|
| ***B41J 13/00*** | (2006.01) |
| ***B65H 35/06*** | (2006.01) |
| ***B41J 11/00*** | (2006.01) |
| ***B65H 43/02*** | (2006.01) |
| *B41J 3/407* | (2006.01) |
| *B41J 13/03* | (2006.01) |
| *B41J 13/28* | (2006.01) |
| *B41J 29/42* | (2006.01) |
| *B41J 15/04* | (2006.01) |
| *B41J 2/33* | (2006.01) |
| *B65H 35/00* | (2006.01) |
| *B65H 29/12* | (2006.01) |

(52) U.S. Cl.

CPC ..... *B41J 11/663* (2013.01); *B41J 13/0036* (2013.01); *B65H 35/06* (2013.01); *B65H 43/02* (2013.01); *B41J 2/33* (2013.01); *B41J 3/4075* (2013.01); *B41J 11/003* (2013.01); *B41J 13/03* (2013.01); *B41J 13/28* (2013.01); *B41J 15/044* (2013.01); *B41J 29/42* (2013.01); *B41J 2202/32* (2013.01); *B65H 29/12* (2013.01); *B65H 35/006* (2013.01); *B65H 2404/1441* (2013.01); *B65H 2801/12* (2013.01)

(56) References Cited

U.S. PATENT DOCUMENTS

| | | | | |
|---|---|---|---|---|
| 6,793,425 | B2 * | 9/2004 | Yoshikawa | B65H 1/266 400/636 |
| 8,582,990 | B2 * | 11/2013 | Ishida | H04N 5/2256 399/370 |
| 9,440,463 | B2 * | 9/2016 | Kudo | B41J 11/663 |
| 2018/0326760 | A1 | 11/2018 | Sasaki | |

FOREIGN PATENT DOCUMENTS

| | | | |
|---|---|---|---|
| JP | 4566817 | B2 | 10/2010 |
| JP | 2017-43480 | A | 3/2017 |

* cited by examiner

PRINTER CONFIGURED TO SET OPERATION MODE TO ONE OF FIRST MODE AND SECOND MODE FOR APPROPRIATELY DETERMINING WHETHER TO ALLOW SUBSEQUENT PRINT CONTROL

CROSS REFERENCE TO RELATED APPLICATION

This application claims priority from Japanese Patent Application No. 2019-046681 filed Mar. 14, 2019. The entire content of the priority application is incorporated herein by reference.

TECHNICAL FIELD

The present disclosure relates to a printer.

BACKGROUND

Japanese Patent Application Publication No. 2017-43480 discloses a printer that performs printing on a medium. Once an image is printed on a medium, the medium is conveyed to a portion between a pair of discharge rollers, and is cut using a cutter in a state where the medium is nipped at the portion between the pair of discharge rollers. A sensor is configured to detect presence or absence of the medium cut by the cutter (hereinafter referred to as "segmented medium"). When the detection result by the sensor shows that the segmented medium has been removed from the portion between the discharge rollers, subsequent printing operation is enabled. The subsequent printing operation is performed upon receipt of new print instruction.

SUMMARY

There are various kinds of mediums having materials, width, and etc. different from one another. These various kinds of mediums can be detected using a high-performance sensor. In such a case, the configuration of the sensor becomes complicated, which leads to increase in size and cost of a printer. If a sensor having a simple configuration is employed in a printer, presence or absence of the medium within the printer may be erroneously detected. Hence, there is a likelihood that subsequent print operation is permitted in a state where the medium is still nipped between discharge rollers (i.e., the medium has not been removed from the portion between the discharge rollers). In the latter case, a medium printed in the subsequent print operation may interfere with the medium still nipped between the discharge roller and the counter roller, thereby causing jam of the media in the printer.

In view of the foregoing, it is an object of the present disclosure to provide a printer in which jam of mediums can be avoided while restraining a complication of a mechanism of a sensor for detecting the mediums.

In order to attain the above and other objects, according to one aspect, the disclosure provides a printer including: a printing head; a conveyor; a cutter; a discharge roller; a counter roller; a sensor; and a controller. The printing head is configured to perform printing on a medium. The conveyor is configured to convey the medium in a conveying direction. The cutter is positioned downstream of the printing head and the conveyor in the conveying direction. The cutter is configured to cut the medium to provide a segmented medium. The discharge roller is positioned downstream of the cutter in the conveying direction. The counter roller is positioned to face the discharge roller and configured to nip the medium in cooperation with the discharge roller. The sensor is positioned downstream of the cutter in the conveying direction. The sensor is configured to detect whether the segmented medium remains at a portion between the discharge roller and the counter roller. The controller is configured to perform: (a) acquiring information indicative of kind of the medium, the kind of medium being classified into either one of a first kind and a second kind; (b) setting, when the kind of the medium acquired in the (a) acquiring is the first kind, an operation mode to a first mode; (c) setting, when the kind of the medium acquired in the (a) acquiring is the second kind, the operation mode to a second mode; (d) controlling, when a first print instruction has been acquired, the printing head and the conveyor to perform a first print control on the medium, the first print control being first performed based on the acquired first print instruction to perform printing on the medium; (e) controlling, after completion of the (d) controlling, the cutter to cut the medium; (f) controlling the sensor to detect whether the segmented medium has been removed from the portion between the discharge roller and the counter roller; and (g) permitting a second print control to be performed, the second print control being performed subsequent to the first print control based on a second print instruction acquired subsequent to the first print instruction to perform printing on the medium. When the operation mode is set to the first mode in the (b) setting, the controller performs the (g) permitting after performing the (f) controlling. When the operation mode is set to the second mode in the (c) setting, the controller performs the (g) permitting without performing the (f) controlling.

According to another aspect, the disclosure provides a printer including: a printing head; a conveyor; a cutter; a discharge roller; a counter roller; a sensor; and a controller. The printing head is configured to perform printing on a medium. The conveyor is configured to convey the medium in a conveying direction. The cutter is positioned downstream of the printing head and the conveyor in the conveying direction. The cutter is configured to cut the medium to provide a segmented medium. The discharge roller is positioned downstream of the cutter in the conveying direction. The counter roller is positioned to face the discharge roller and configured to nip the medium in cooperation with the discharge roller. The sensor is positioned downstream of the cutter in the conveying direction. The sensor is configured to detect whether the segmented medium remains at a portion between the discharge roller and the counter roller. The controller is configured to perform: (a) controlling, when a first print instruction has been acquired, the printing head and the conveyor to perform a first print control on the medium, the first print control being first performed based on the acquired first print instruction to perform printing on the medium; (b) controlling, after completion of the (a) controlling, the cutter to cut the medium; (c) controlling, after performing the (b) controlling, the sensor to detect whether the segmented medium remains in the portion between the discharge roller and the counter roller; (d) controlling, when the sensor detects in the (c) controlling that the segmented medium remains in the portion between the discharge roller and the counter roller, the sensor to detect whether the segmented medium has been removed from the portion between the discharge roller and the counter roller; and (e) permitting a second print control to be performed, the second print control being performed subsequent to the first print control based on a second print instruction acquired subsequent to the first print instruction to perform printing on the medium. When the sensor detects in the (c) controlling that the segmented medium remains in the portion between the discharge roller and the counter roller, the controller performs the (e) permitting after performing the (d) controlling. When the sensor detects in the (c) controlling that the segmented medium has been removed from the portion between the discharge roller and the counter roller, the controller performs the (e) permitting without performing the (d) controlling.

According to still another aspect, the disclosure provides a printer including: a printing head; a platen roller; a cutter; a discharge roller; a counter roller; a sensor; and a controller. The printing head is configured to perform printing on a medium. The platen roller is configured to nip the medium in cooperation with the printing head. The cutter is positioned downstream of the printing head and the platen roller in a conveying direction in which the medium is conveyed. The cutter is configured to cut the medium to provide a segmented medium. The discharge roller is positioned downstream of the cutter in the conveying direction. The counter roller positioned to face the discharge roller and configured to nip the medium in cooperation with the discharge roller. The sensor is positioned downstream of the discharge roller and the counter roller in the conveying direction. The sensor is configured to detect whether the segmented medium remains at a portion between the discharge roller and the counter roller. The controller is configured to perform: (a) acquiring information indicative of kind of the medium, the kind of medium being classified into either one of a first kind and a second kind; (b) setting, when the kind of the medium acquired in the acquiring is the first kind, an operation mode to a first mode; (e) setting, when the kind of the medium acquired in the acquiring is the second kind, the operation mode to a second mode; (d) controlling, when a first print instruction has been acquired, the printing head and the platen roller to perform printing on the medium based on the acquired first print instruction; (e) controlling, after completion of the (d) controlling, the cutter to cut the medium; (f) controlling the sensor to detect whether the segmented medium has been removed from the portion between the discharge roller and the counter roller; (g) permitting, when the sensor detects in the (f) controlling that the segmented medium has been removed front the portion between the discharge roller and the counter roller, a second print instruction to be received, the second print instruction being acquired subsequent to the first print instruction to perform printing on the medium; and (h) preventing, when the sensor detects in the (f controlling that the segmented medium remains at the portion between the discharge roller and the counter roller, the second print instruction from being received. When the operation mode is set to the first mode in the (b) setting, the controller performs: the (g) permitting when the sensor detects in the (f) controlling that the segmented medium has been removed from the portion between the discharge roller and the counter roller; and the (h) preventing when the sensor detects in the (f) controlling that the segmented medium remains at the portion between the discharge roller and the counter roller. When the operation mode is set to the second mode in the (c) setting, the controller performs: (i) controlling the discharge roller to be rotated in the discharging direction; and the (g) permitting without executing the (f) controlling, the (g) permitting being performed after the (i) controlling is performed.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
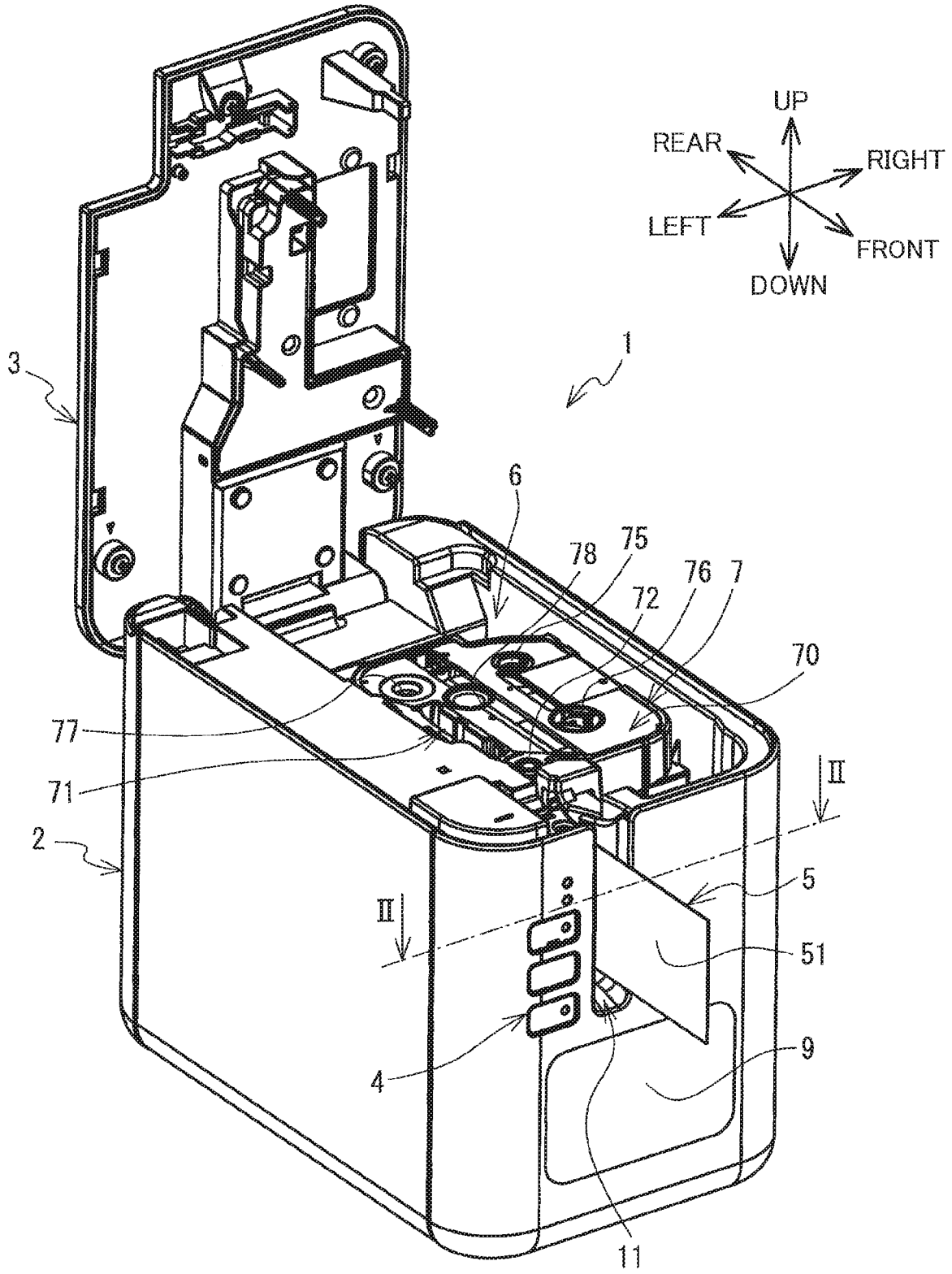
FIG. 1 is a perspective view of a printer according to a first embodiment of the present disclosure.

Hereinafter, a printer 1 according to a first embodiment of the present disclosure will be described with reference to FIGS. 1 through 4. Note that configuration of the printer 1 illustrated in the drawings are merely an example and is not intended to limit the present disclosure.

In the following description, directions with regard to the printer 1 will be described based on a posture of the printer 1 illustrated in FIG. 1. Specifically, a diagonally lower leftward direction, a diagonally upper rightward direction, a diagonally lower rightward direction, a diagonally upper leftward direction, an upward direction, and a downward direction in FIG. 1 are respectively defined as a leftward direction, a rightward direction, a frontward direction, a rearward direction, an upward direction and a downward direction of the printer 1, respectively.

The printer 1 can be connected to an external terminal device (not illustrated) such as a personal computer and a smartphone via a network and a cable (not illustrated). The printer 1 is configured to acquire print data from the external terminal device, for example, and to print an image on an image recording medium (hereinafter simply referred to as "medium") 5 on a basis of the acquired print data.

As illustrated in FIG. 1, the printer 1 includes a housing 2 and a cover 3. The cover 3 is pivotally movably supported by the housing 2 to open and close an upper open end of the housing 2. An input portion 4 is provided at a left-upper corner portion of a front surface of the housing 2. A user of the printer 1 can input various information into the printer 1 by operating the input portion 4. A display portion 9 is provided at a position below the input portion 4. The display portion 9 is configured to display various information thereon.

A discharge opening 11 is formed in the front surface of the housing 2 at a position rightward of the input portion 4. The discharge opening 11 is open and extends in an upward/downward direction. The discharge opening 11 is configured to discharge a segmented medium 51 (described later) to an outside of the housing 2. A cassette receiving portion 6 is provided at an upper portion of the housing 2. The cassette receiving portion 6 is recessed downward from the upper open end of the housing 2. A cassette 7 is attachable to and detachable from the cassette receiving portion 6.

Figure 2:
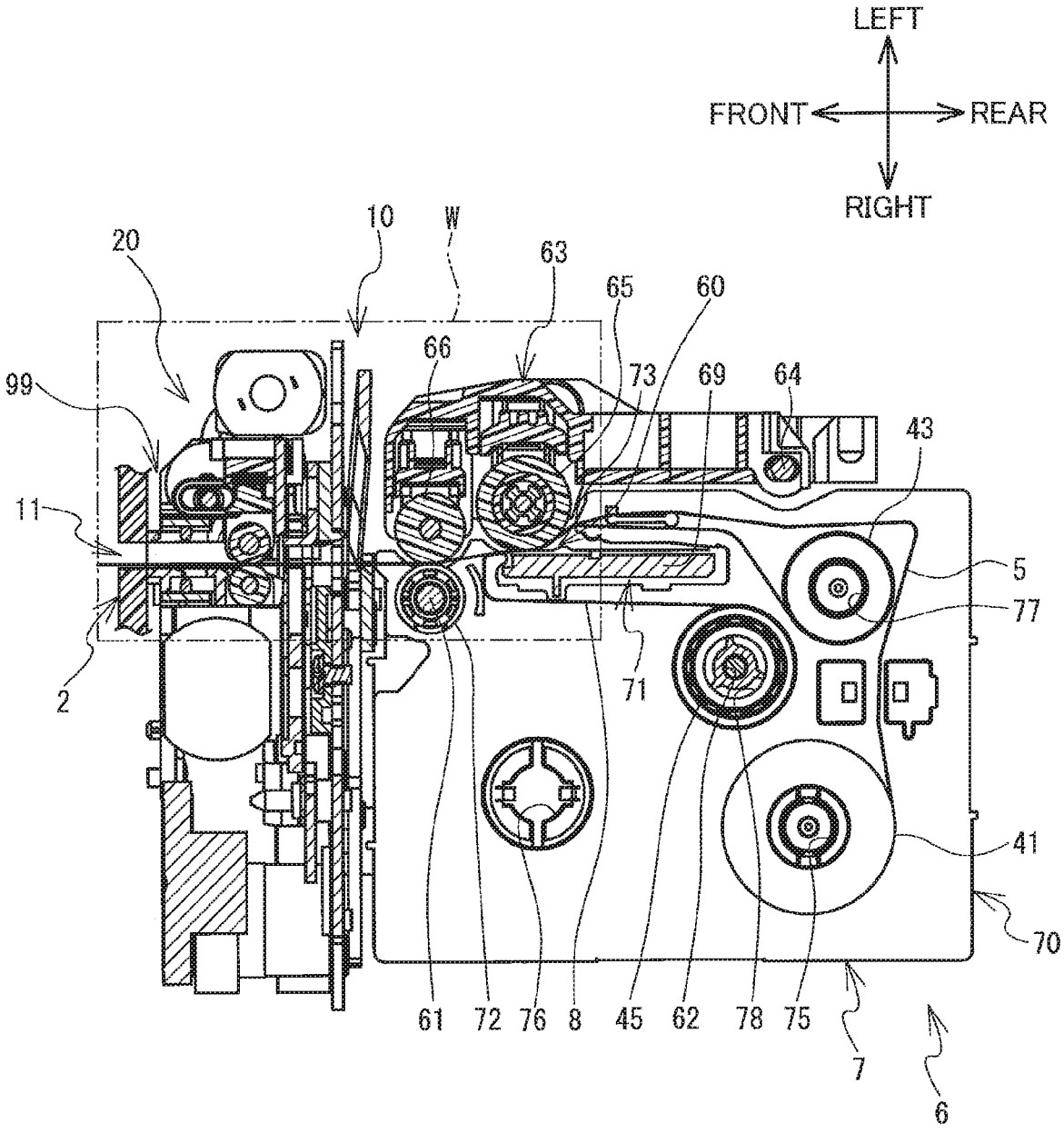
FIG. 2 is a cross-sectional view taken along a line II-II in FIG. 1 in which a housing of the printer according to the first embodiment is partially removed.

As illustrated in FIG. 2, the cassette receiving portion 6 includes a thermal head 60, a drive shaft 61, a ribbon take-up shaft 62, and a head holder 69. The head holder 69 is positioned at a left portion of the cassette receiving portion 6. The thermal head 60 is provided at a left surface of the head holder 69. The drive shaft 61 is positioned frontward of the head holder 69, and extends in the upward/downward direction. The ribbon take-up shaft 62 is positioned rightward and rearward of the head holder 69, and extends in the upward/downward direction.

A shaft 64 is provided at a position leftward of a rear portion of the cassette receiving portion 6. The shaft 64 extends in the upward/downward direction, and pivotally movably supports a rear end portion of a platen holder 63. The platen holder 63 rotatably supports a platen roller 65 and a conveying roller 66. The platen roller 65 faces the thermal head 60 from the left side thereof. The conveying roller 66 is at a position frontward of the platen roller 65, and faces the drive shaft 61 from the left side thereof. When the platen holder 63 is pivotally moved about an axis of the shaft 64, a front end portion of the platen holder 63 is moved in a direction substantially parallel to a leftward/rightward direction so that the platen roller 65 and the conveying roller 66 are moved between a position proximity to the thermal head 60 and the drive shaft 61. (see FIG. 2) and a position farther away from the thermal head 60 and the drive shaft 61 (not illustrated).

The drive shaft 61, the ribbon take-up shaft 62, the platen roller 65, and the conveying roller 66 are connected to a conveyer motor 91 (see FIG. 5) through a gear(s) (not illustrated). As the conveyer motor 91 starts to be driven, the drive shaft 61, the platen roller 65, and the conveying roller 66 are rotated to convey the medium 5 in a conveying direction (i.e., the frontward direction and the ribbon take-up shaft 62 is rotated to take up an ink ribbon 8.

Figure 3:
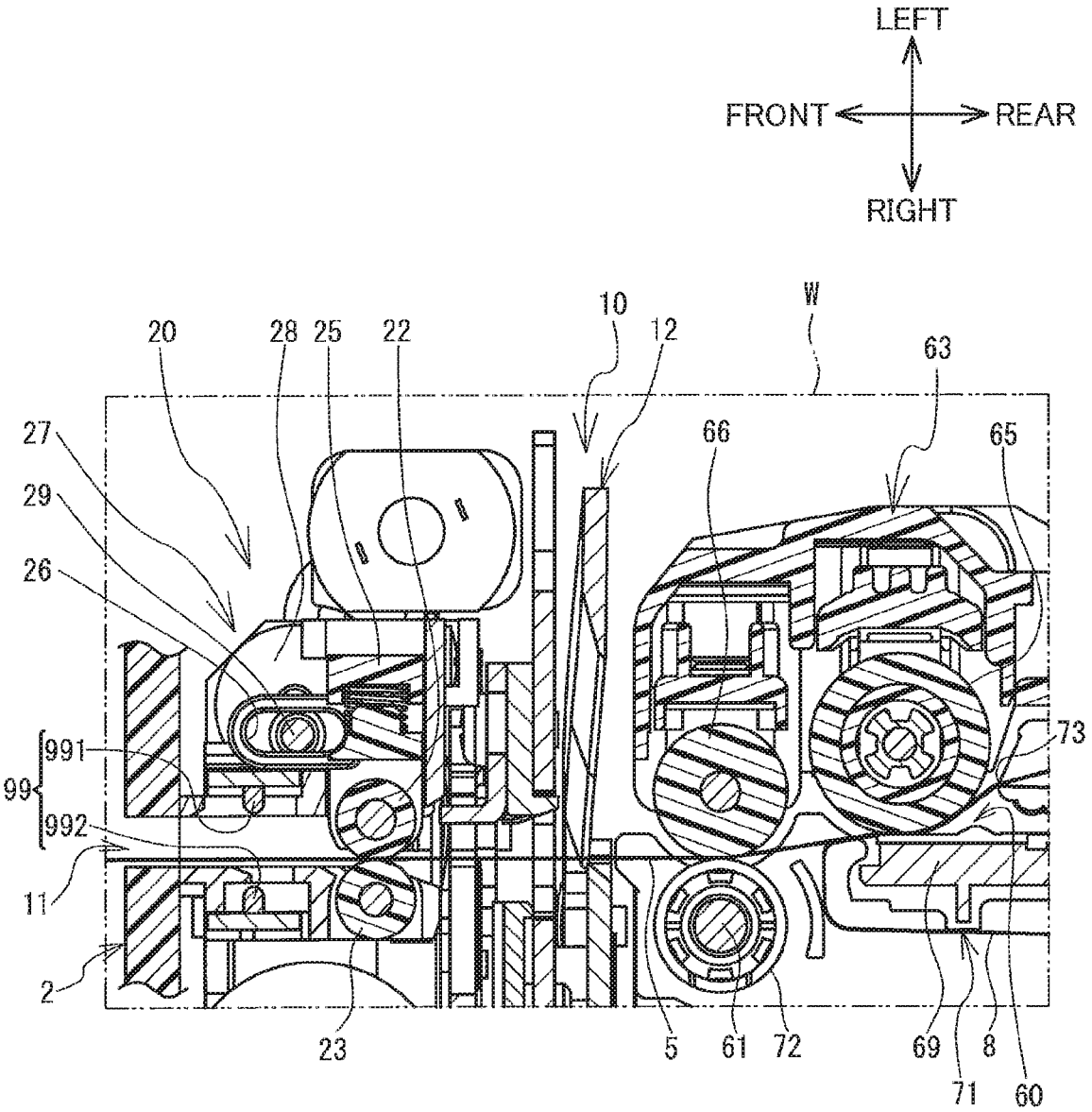
FIG. 3 is an enlarged view of a region illustrated in FIG. 2, and particularly illustrating a state where a discharge roller in the printer according to the first embodiment is at its nipping position.

As illustrated in FIG. 3, the printer 1 includes a cutter unit 10 and a discharge unit 20 those provided inside the housing 2 at a position adjacent to and rearward of the discharge opening 11. The cutter unit 10 includes a cutting blade 12. The cutting blade 12 is positioned downstream of both the thermal head 60 and the conveying roller 66 in the conveying direction and capable of cutting the medium 5. That is, the cutting blade 12 is capable of completely cutting the medium 5 into two separate parts. The cutting blade 12 is connected to a cutter motor 92 (see FIG. 5) through a gear(s) (not illustrated). When the cutter motor 92 starts to be driven, the cutting blade 12 cuts the medium 5.

In the following description, a portion of the medium 5 cut away by the cutting blade 12 will be referred to as "segmented medium 51" (see FIG. 1). That is, of the two separate parts of the medium 5, the segmented medium 51 is the leading portion cut away from the remaining portion of the medium 5 and discharged to the outside of the housing 2.

The discharge unit 20 includes a discharge roller 22, a counter roller 23, a roller holder 25, and a movable mechanism 27. The discharge roller 22 and the counter roller 23 are positioned downstream of the cutting blade 12 in the conveying direction. The discharge roller 22 extends in the upward/downward direction at a position leftward of the conveyed medium 5. The counter roller 23 extends in the upward/downward direction at a position rightward of the conveyed medium 5. The discharge roller 22 and the counter roller 23 face each other in the leftward/rightward direction with the conveyed medium 5 interposed therebetween. The discharge roller 22 and the counter roller 23 are made of elastic material.

The roller holder 25 supports the discharge roller 22, and is formed with an elongated slot 26. The movable mechanism 27 includes a rotator 28 and an eccentric shaft 29, The eccentric shaft 29 extends upward from the rotator 28 and is inserted through the elongated slot 26. The eccentric shaft 29 is eccentric with respect to the rotator 28, The rotator 28 is connected to a discharge motor 93 (see FIG. 5) through a gear(s) (not illustrated). A one-way clutch (not illustrated) is provided at the gear(s). The discharge motor 93 is driven and can make forward rotation and make reverse rotation.

Figure 4:
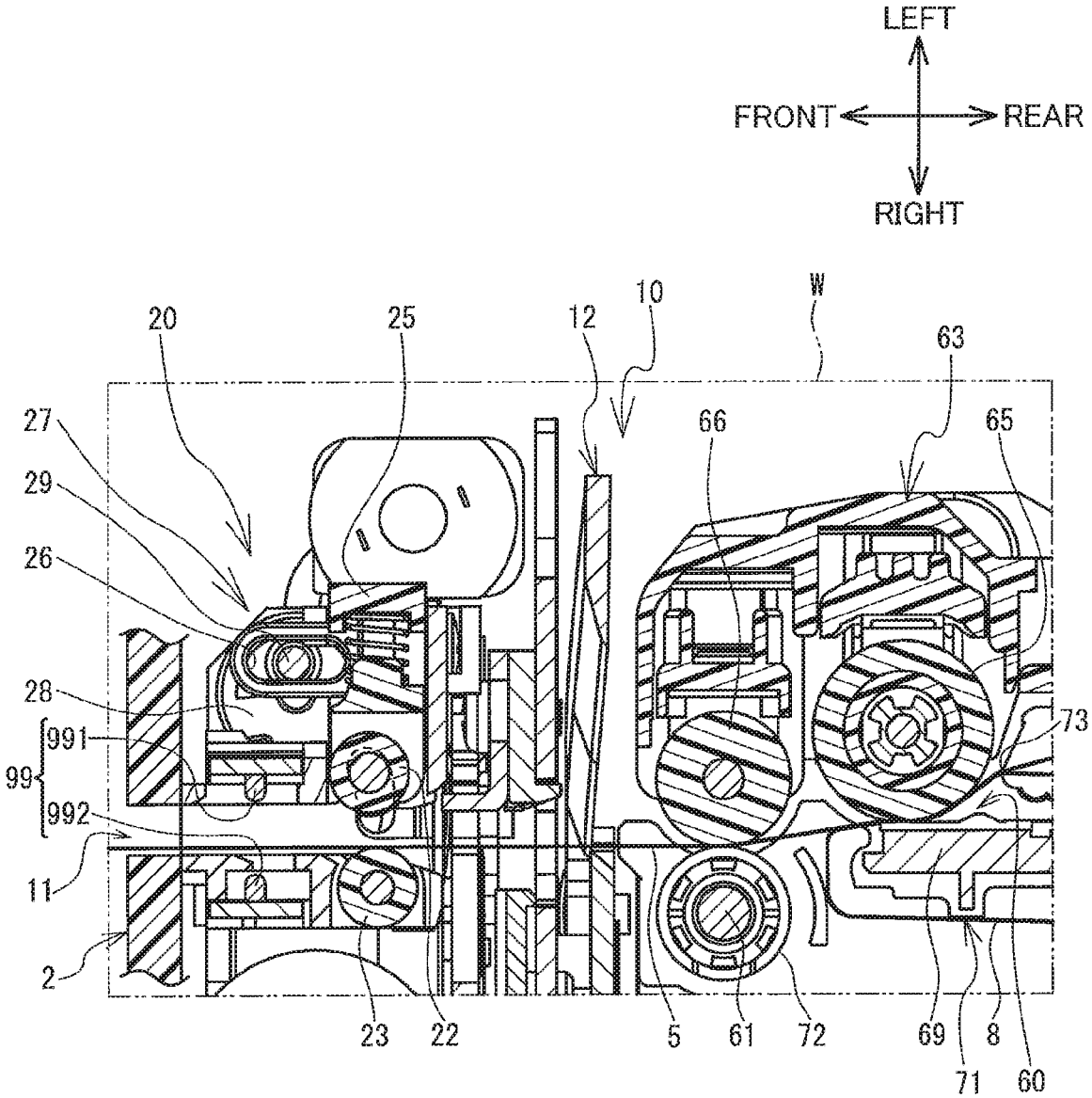
FIG. 4 is an enlarged view of the region illustrated in FIG. 2, and particularly illustrating a state where the discharge roller in the printer according to the first embodiment is at its release position.

As illustrated in FIGS. 3 and 4, in accordance with the reverse rotation of the discharge motor 93, the rotator 28 is rotated through the gear(s), whereby the eccentric shaft 29 moves the roller holder 25 in the leftward/rightward direction. In this way, the movable mechanism 27 moves the discharge roller 22 toward and away from the counter roller 23. In the following description, a position where the discharge roller 22 is in the proximity to the counter roller 23 will be referred to as "nipping position" (see FIG. 3), and a position where the discharge roller 22 is positioned leftward and away from the counter roller 23 will be referred to as "release position" (see FIG. 4).

As illustrated in FIG. 3, the discharge roller 22 at the nipping position is in contact with the counter roller 23. With this configuration, the medium 5 conveyed by the conveying roller 66 is nipped between the discharge roller 22 and the counter roller 23 when the discharge roller 22 is at the nipping position. As illustrated in FIG. 4, the discharge roller 22 is positioned away from the counter roller 23 with a gap greater than a thickness of the medium 5 when the discharge roller 22 is at the release position. Hence, the discharge roller 22 at the release position is positioned away from the conveyed medium 5.

When the discharge motor 93 makes forward rotation, the discharge roller 22 rotates in a discharging direction so that the segmented medium 51 is conveyed downstream in the conveying direction. In the present embodiment, the discharging direction is a clockwise direction in plan view in FIG. 3. Even when the discharge motor 93 makes forward rotation, the rotation of the rotator 28 is prevented by the function of the one-way clutch. Accordingly, the discharge roller 22 rotates in the discharging direction while the position of the discharge roller 22 is maintained at the nipping position.

Next, the cassette 7 will next be described with reference to FIG. 2. Description as to the configuration of the cassette 7 will be made based on a posture of the cassette 7 attached to the cassette receiving portion 6. Cassettes of a receptor type, a thermal type, a laminate type and the like are available as the cassette 7. FIG. 2 illustrates the receptor type cassette 7 as an example.

The cassette 7 includes a case 70, and a drive roller 72. The case 70 is formed with a head opening 71 and a medium ejection opening 73 at a left-front portion thereof. The head opening 71 penetrates the case 70 in the upward/downward direction, and opens leftward at a position between the medium ejection opening 73 and the drive roller 72. The head holder 69 and the thermal head 60 are positioned within the head opening 71. The medium ejection opening 73 is formed at a position leftward of the head opening 71, and opens frontward.

The drive roller 72 is positioned at a left-front corner portion of the case 70 and extends in the upward/downward direction. The drive roller 72 has a hollow cylindrical shape and is rotatably supported by the case 70. The drive shaft 61 is inserted into the drive roller 72. The drive roller 72 has a left end portion exposed to an outside of the case 70 to nip the medium 5 in cooperation with the conveying roller 66.

Further, the ease 70 is formed with support holes 75, 76, 77, and 78 penetrating the case 70 in the upward/downward direction. The support hole 75 rotatably supports a first medium spool 41 around which a first medium is wound. The support hole 76 is configured to rotatably support a second medium spool (not illustrated) around which a second medium is wound. The support hole 77 rotatably supports a ribbon supply spool 43 around which the ink ribbon 8 prior to printing is wound. The support hole 78 rotatably supports a ribbon take-up spool 45 around which the ink ribbon 8 already used for printing is wound. The ribbon take-up shaft 62 is inserted into the ribbon take-up spool 45.

In the receptor type cassette 7, the second medium spool for winding the second medium is not provided and thus not illustrated in the cassette 7 in FIG. 2, but the first medium spool 41 for winding the medium 5 as the first medium, the ribbon supply spool 43 and the ribbon take-up spool 45 are provided. As the medium 5, a non-laminate tape, a fabric tape, a satin tape, and a heat-shrink tube are available. Regarding the thermal type cassette, the second medium spool, the ribbon supply spool 43 and the ribbon take-up spool 45 are not provided, but the first medium spool 41 is provided. A heat sensitive tape is used as the first medium.

Regarding the laminate type cassette, the first medium spool 41, the second medium spool, the ribbon supply spool 43, and the ribbon take-up spool 45 are provided. Double-sided adhesive tape is used as the first medium. A film tape is used as the second medium. The double-sided adhesive tape is superposed on the film tape at a position between the conveying roller 66 and the drive roller 72, and is discharged together as a laminate tape.

With the above configuration, as the cover 3 (see FIG. 1) is closed, the platen roller 65 and the conveying roller 66 are moved rightward toward and approaches the thermal head 60 and the drive shaft 61 from the left side thereof, respectively. Hence, the platen roller 65 urges both the medium 5 and the ink ribbon 8 against the thermal head 60 with the medium 5 and the ink ribbon 8 superposed on each other. The conveying roller 66 urges the medium 5 against the drive roller 72.

When the ribbon take-up shaft 62 is rotated in accordance with driving of the conveyer motor 91 (see FIG. 5), the ink ribbon 8 is drawn out from the ribbon supply spool 43 since the ribbon take-up spool 45 takes up the ink ribbon 8. The drawn out ink ribbon 8 is pulled to a left-front portion of the head opening 71 through the medium ejection opening 73, and then is moved past a portion between the platen roller 65 and the thermal head 60 to be conveyed toward the ribbon take-up spool 45.

As the drive shaft 61, the platen roller 65 and the conveying roller 66 is rotated due to the driving of the conveyer motor 91, the medium 5 is drawn out from the first medium spool 41. The drawn out medium 5 is pulled to the left-front portion of the head opening 71 through the medium ejection opening 73. Then, the medium 5 is moved past the portion between the platen roller 65 and the thermal head 60 and a portion between the conveying roller 66 and the drive roller 72, and is conveyed toward the cutter unit 10.

Figure 5:
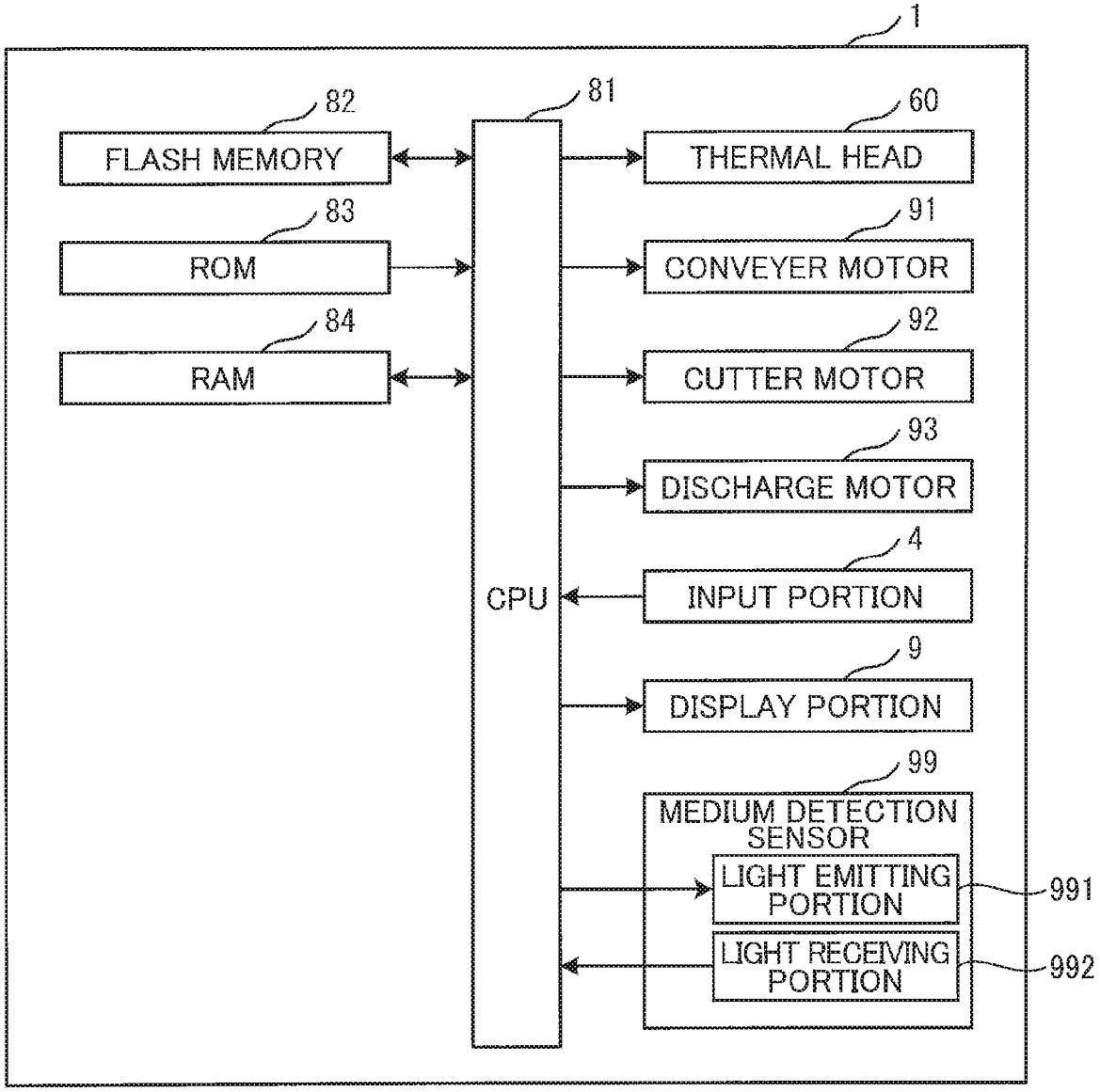
FIG. 5 is a block diagram illustrating an electrical configuration in the printer according to the first embodiment.

An electrical configuration in the printer 1 will next be described with reference to FIG. 5. As illustrated in FIG. 5, the printer 1 further includes a CPU 81. The CPU 81 functions as a processor for executing a first main routine (described later) illustrated in FIG. 6 to perform overall control of the printer 1. A flash memory 82, a ROM 83, a RAM 84, the thermal head 60, the conveyer motor 91, the cutter motor 92, the discharge motor 93, the input portion 4, the display portion 9, and a medium detection sensor 99 are connected to the CPU 81.

The flash memory 82 is a non-transitory storage medium that stores therein programs for the CPU 81 to execute the first main routine and printing information for the thermal head 60 to perform printing on the medium 5. The ROM 83 is a non-transitory storage medium configured to store therein various parameters needed in the CPU 81 to execute various programs. The RAM 84 is a transitory storage medium configured to store therein temporary data of timer, counter and a flag.

The medium detection sensor 99 is positioned downstream of the cutting blade 12, and specifically, positioned downstream of the discharge roller 22 (see FIG. 3) in the conveying direction. The medium detection sensor 99 is a transmissive photosensor and includes a light emitting portion 991 and a light receiving portion 992. The light emitting portion 991 and the light receiving portion 992 are positioned to oppose each other with respect to a conveying passage of the medium 5 (see FIG. 3).

The medium detection sensor 99 is configured to output ON signal to the CPU 81 in a case where there remains the segmented medium 51 nipped at the position between the discharge roller 22 and the counter roller 23. On the other hand, the medium detection sensor 99 is configured to output OFF signal to the CPU 81 in a case where no segmented medium 51 is nipped at the position between the discharge roller 22 and the counter roller 23. In this way, the medium detection sensor 99 detects whether the segmented medium 51 is nipped between the discharge roller 22 and the counter roller 23.

Next, the first main routine will be described with reference to FIG. 6. In a state where the cassette 7 is attached to the cassette receiving portion 6 and the cover 3 is closed, the printer 1 is powered by a user. As electric power is supplied to the printer 1, the CPU 81 expands in the RAM 84 program stored in the flash memory 82 to start the first main routine.

Figure 6:
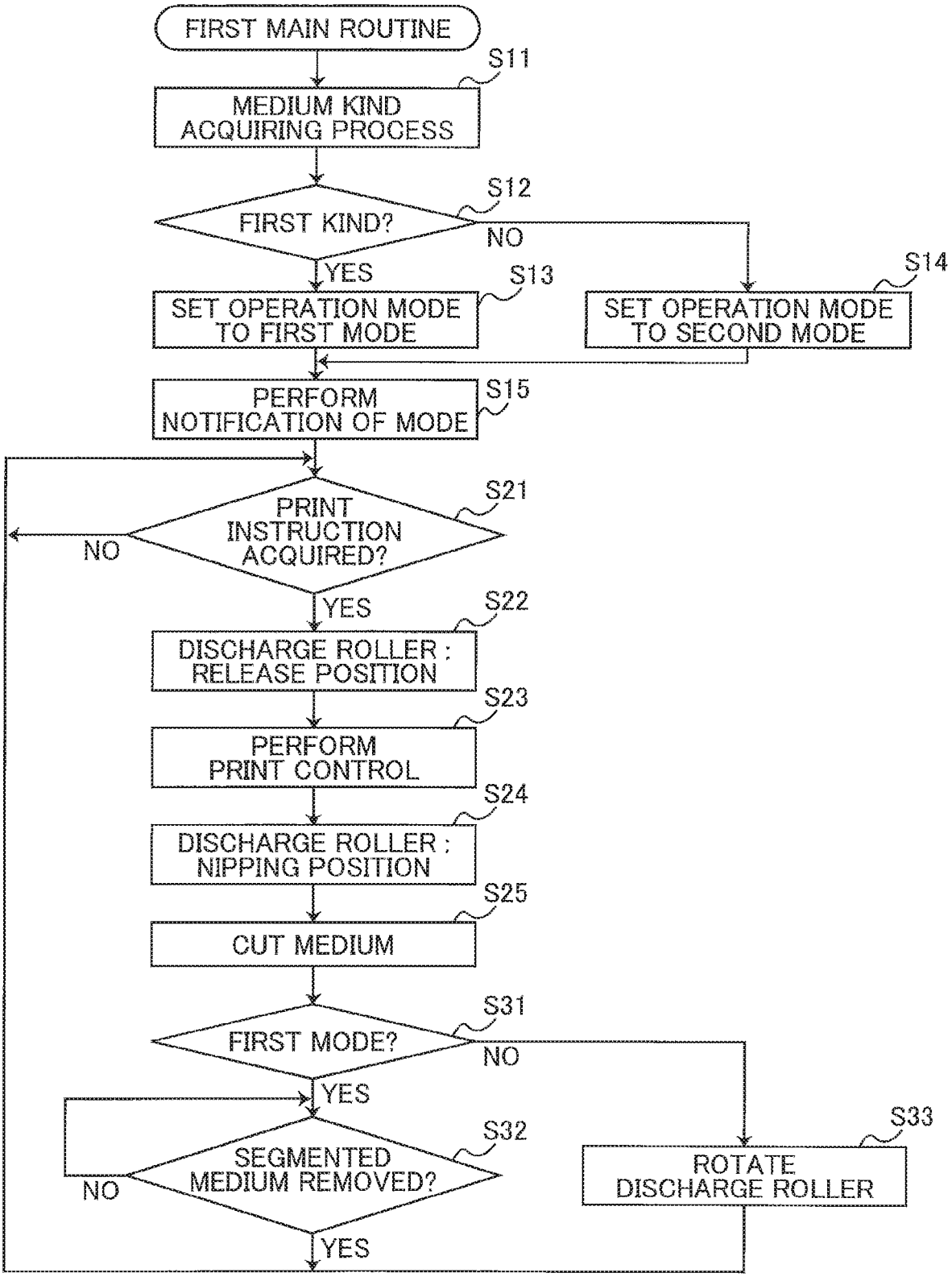
FIG. 6 is a flowchart illustrating a first main routine executed by a CPU in the printer according to the first embodiment.

As illustrated in FIG. 6, at the beginning of the first main routine, in S11 the CPU 81 executes a medium kind acquiring process. As described above, there are various kinds of the mediums 5 (hereinafter simply referred to as "medium kind") accommodated in the cassette 7. Here, the mediums 5 have differences in the presence or absence of through-holes, a width, a rigidity, a light transmittance, a specular reflectance, a diffuse reflectance, and a refractive index for each medium kind. The user operates the input portion 4 to input the medium kind of the medium 5 accommodated in the cassette 7 into the printer 1. In the medium kind acquiring process, the CPU 81 acquires the medium kind inputted by the user. The CPU 81 stores the acquired medium kind in the RAM 84.

In S12 the CPU 81 determines whether the medium kind stored in the RAM 84 is a first kind. According to the first embodiment, the medium kind is classified into either one of a first kind and a second kind dependent on the presence or absence of the through-holes, a width, a rigidity, a light transmittance, and a refractive index of the medium 5. Specifically, the medium kind is classified into the first kind in a case where the detection accuracy of the medium detection sensor 99 with respect to the medium 5 is higher than or equal to a prescribed value, while the medium kind is classified to the second kind in a case where the detection accuracy of the medium detection sensor 99 with respect to the medium 5 is lower than the prescribed value. That is, the way how the medium kind is classified into one of the first kind and the second kind is dependent on the kinds of medium detection sensor 99 (see FIG. 5).

According to the first embodiment, the medium detection sensor 99 is a transmissive photosensor. Hence, the detection accuracy of the medium detection sensor 99 with respect to the medium 5 is higher than or equal to the prescribed value when all of the following conditions are satisfied: the medium 5 is not formed with through-holes; the medium 5 has a width greater than or equal to a prescribed width; the medium 5 has a rigidity greater than or equal to a prescribed rigidity; the medium 5 provides a light transmittance less than or equal to a prescribed level; and the medium 5 provides a refractive index greater than or equal to a prescribed level.

On the other hand, the detection accuracy of the medium detection sensor 99 with respect to the medium 5 is lower than the prescribed value when at least one of the following conditions is satisfied: the medium 5 is formed with through-holes; the medium 5 has the width less than the prescribed width; the medium 5 has the rigidity less than the prescribed rigidity; the medium 5 provides the light transmittance greater than or equal to than the prescribed level; and the medium 5 provides the refractive index less than the prescribed level.

Accordingly, the kind of the medium 5 satisfying all of the following conditions, i.e., absence of through-holes, the width greater than or equal to the prescribed width, the rigidity greater than or equal to the prescribed rigidity, the light transmittance less than or equal to the prescribed level, and the refractive index greater than or equal to the prescribed level is classified into the first kind. On the other hand, the kind of the medium 5 satisfying at least one of the following conditions, i.e., presence of through-holes, the width less than the prescribed width, the rigidity less than the prescribed rigidity, the light transmittance greater than the prescribed level, and the refractive index less than the prescribed level is classified into the second kind.

The ROM 83 previously stores therein a table (not illustrated) correlating one of the first kind and second kind with the medium kind. In S12 the CPU 81 determines whether the acquired medium kind is the first kind or the second kind by referring to the table stored in the ROM 83. When the CPU 81 determines that the acquired medium kind is the first kind (S12: YES), in S13 the CPU 81 sets an operation mode to a first mode in the RAM 84, and then advances to the process in S15. On the other hand, when the CPU 81 determines that the acquired medium kind is the second kind (S12: NO), in S14 the CPU 81 sets the operation mode to a second mode in the RAM 84, and advances to the process in S15. That is, the operation mode of the printer 1 in the first main routine has the first mode and the second mode. As will be described later, the CPU 81 performs separate process dependent on the set operation mode after the medium 5 is cut in the process in S25.

In S15 the CPU 81 performs notification of mode to notify a user that the operation mode in the RAM 84 is set to which one of the first mode and the second mode. In the first embodiment, the CPU 81 performs the notification of mode by displaying the set operation mode on the display portion 9. Accordingly, the user can recognize that the operation mode is set to either one of the first mode and the second mode.

Then, in S21 the CPU 81 determines whether the CPU 81 has acquired print instruction for performing printing on the medium 5. The print instruction includes print information. The user operates the external terminal device to input print instruction into the printer 1. When the CPU 81 determines that print instruction has not been acquired (S21: NO), the CPU 81 waits and repeatedly executes the process in S21 until the print instruction is inputted.

When the CPU 81 determines that the CPU 81 has acquired print instruction through the network, the cable and the like (S21: YES), in S22 the CPU81 controls the discharge motor 93 to make reverse rotation to move the discharge roller 22 to the release position (see FIG. 4). Accordingly, the discharge roller 22 does not prevent the conveyance of the medium 5 while print control is performed.

Subsequently, in S23 the CPU 81 performs print control. During the print control, the CPU 81 controls the conveyer motor 91 and the thermal head 60 based on the print information included in the acquired print instruction. Therefore, printing on the medium 5 by the thermal head 60 is performed while the medium 5 is conveyed by the conveying roller 66.

In S24 the CPU 81 controls the discharge motor 93 to make reverse rotation so that the discharge roller 22 moves to the nipping position (see FIG. 3). As a result, the medium 5 is nipped between the discharge roller 22 and the counter roller 23. In this state, the CPU 81 prevents the discharge motor 93 from making forward rotation that causes rotation of the discharge roller 22. That is, a state where the medium 5 is nipped between the discharge roller 22 and the counter roller 23 is maintained.

In S25 the CPU 81 drives the cutter motor 92 to cause the cutting blade 12 to cut the medium 5 while the forward rotation of the discharge motor 93 is prevented (i.e., in a state where the rotation of the discharge roller 22 is halted), whereby the segmented medium 51 is provided.

Next, in S31 the CPU 81 determines whether the operation mode stored in the RAM 84 is the first mode or not. When the CPU 81 determines that the operation mode stored in the RAM 84 is the first mode (S31: YES), the CPU 81 proceeds to the process in S32, However, when determining that the operation mode stored in the RAM 84 is the second mode (S31: NO), the CPU 81 proceeds to the process in S33. As will be described below, the CPU 81 determines under different conditions whether to allow subsequent print control to be executed dependent on whether the operation mode is set to the first mode or the second mode in the RAM 84.

In S32 the CPU 81 determines, on a basis of the detection signal outputted from the medium detection sensor 99, whether the segmented medium 51 has been removed by the user, i.e., the segmented medium 51 does not remain at the position between the discharge roller 22 and the counter roller 23. The CPU 81 determines that the segmented medium 51 remains nipped between the discharge roller 22 and the counter roller 23 in response to receiving ON signal transmitted from the medium detection sensor 99 (S32: NO).

In this case, the CPU 81 repeatedly executes the process in S32 until the CPU 81 determines that the segmented medium 51 has been removed from the portion between the discharge roller 22 and the counter roller 23. Accordingly, the CPU 81 cannot receive new print instruction in S21 unless the CPU 81 determines in S32 that the segmented medium 51 does not remain at the portion between the discharge roller 22 and the counter roller 23, preventing execution of subsequent print control.

The medium detection sensor 99 outputs OFF signal in response to detecting that the user removes the segmented medium 51 away from the portion between the discharge roller 22 and the counter roller 23. The CPU 81 determines that the segmented medium 51 has been removed from the portion between the discharge roller 22 and the counter roller 23 in response to receipt of OFF signal outputted from the medium detection sensor 99 (S32: YES), In this case, the CPU 81 returns to the process in S21.

Through this operation, the CPU 81 is ready to receive new print instruction in S21, and hence, execution of subsequent print control is permitted. In this way, when the operation mode set in the RAM 84 is the first mode, the CPU 81 determines whether subsequent print control is permitted on a basis of the detection signal outputted from the medium detection sensor 99.

In S33 the CPU 81 drives the discharge motor 93 to make forward rotation, thereby rotating the discharge roller 22 at the nipping position (see FIG. 3) in the discharging direction. Therefore, the segmented medium 51 is discharged downstream from the portion between the discharge roller 22 and the counter roller 23. Then, the CPU 81 returns to the process in S21. Accordingly, the CPU 81 cannot receive new print instruction in S21 unless the discharge roller 22 rotates in the discharging direction. Consequently, execution of subsequent print control is prevented.

On the other hand, after the discharge roller 22 is rotated in the discharging direction in S33, the CPU 81 is ready to receive new print instruction in S21. That is, execution of subsequent print control is permitted. In this way, when the operation mode is set to the second mode in the RAM 84, the CPU 81 determines whether subsequent print control can be performed based on whether the discharge roller 22 has been rotated in the discharging direction by the forward rotation of the discharge motor 93.

As described above, in a case where the medium kind is the first kind, even after the print control is terminated, execution of subsequent print control is not permitted unless the medium detection sensor 99 detects that the segmented medium 51 has been removed from the portion between the discharge roller 22 and the counter roller 23. Therefore, the printer 1 can securely prevent the subsequent print control from being executed in a state where the segmented medium 51 remains at the portion between the discharge roller 22 and the counter roller 23.

Further, in a case where the medium kind is the second kind, even after the print control is terminated, execution of subsequent print control is not permitted unless the discharge roller 22 is rotated in the discharging direction due to the forward rotation of the discharge motor 93. With this operation, the printer 1 can securely prevent the subsequent print control from being executed in the state where the segmented medium 51 remains at the portion between the discharge roller 22 and the counter roller 23.

Accordingly, irrespective of the medium kind of the medium 5, the printer 1 can prevent execution of subsequent print control in the state where the segmented medium 51 remains at the portion between the discharge roller 22 and the counter roller 23, whereby jam of the mediums within the printer 1 can be restrained. Since the medium 5 whose presence or absence is more likely to be erroneously detected by the medium detection sensor 99 is classified to the second kind in the present embodiment, a sensor having a complicated mechanism for detecting the segmented medium 51 of the second kind is not needed. Consequently, the printer 1 can restrain jam of the media without employing the medium detection sensor 99 using the complicated mechanism.

Further, since the printer 1 is provided with the input portion 4, the CPU 81 can easily acquire medium kind of the medium 5 just by the user's input of the medium kind through the input portion 4.

Further, the medium detection sensor 99 is a transmissive photosensor, and when at least one of the following conditions is satisfied, the medium kind of the medium 5 is classified into the second kind: the medium 5 is formed with through-holes; the medium 5 has the width less than the prescribed width; the medium 5 has the rigidity less than the prescribed rigidity; the medium 5 provides the light transmittance greater than or equal to than the prescribed level; and the medium 5 provides a refractive index less than the prescribed level. In other words, when the detection accuracy using the transmissive photosensor with respect to the segmented medium 51 is low, the medium kind is classified into the second kind. Accordingly, the printer 1 can avoid erroneous detection of presence or absence of the segmented medium 51 by the medium detection sensor 99.

Next, a printer 1 according to a second embodiment will be described with reference to FIG. 7. Mechanical configuration of the printer 1 according to the second embodiment is the same as that in the first embodiment. The second embodiment is different from the first embodiment in that the CPU 81 executes a second main routine illustrated in FIG. 7 instead of executing the first main routine. In the second main routine, the CPU 81 executes the process in S41 in place of the process in S33 of the first main routine. The remaining processes in S11 to S15, S21 to S25, S31 and S32 are the same as those in the first main routine so that the description as to these processes will be omitted to avoid duplicating description. As the printer 1 is powered by the user, the CPU 81 expands in the RAM 84 program stored in the flash memory 82 to start the second main routine.

Figure 7:
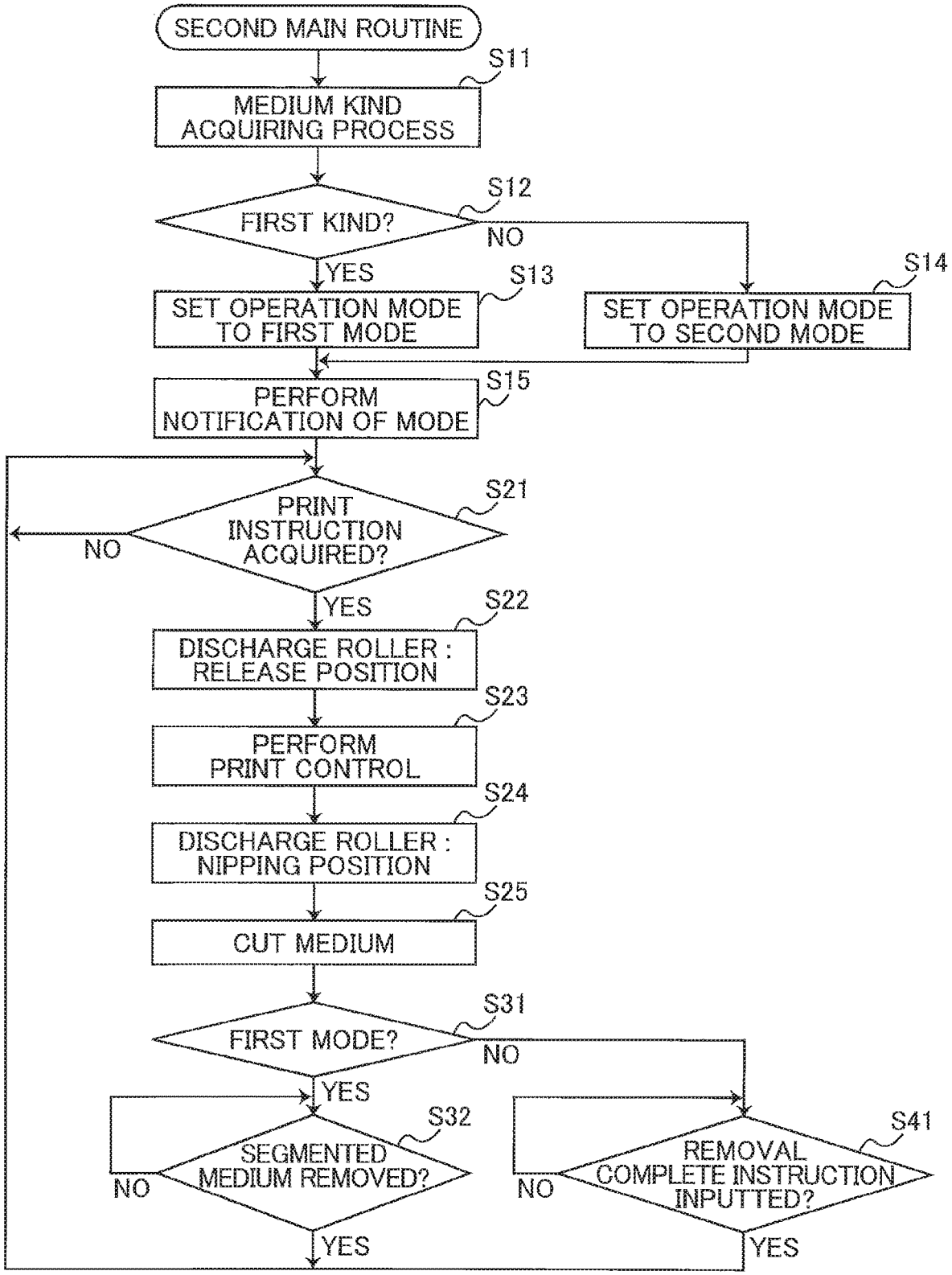
FIG. 7 is a flowchart illustrating a second main routine executed by a CPU in a printer according to a second embodiment.

As illustrated in FIG. 7, when the CPU 81 determines in S31 that the operation mode has been set to the second mode in the RAM 84 (S31: NO), in S41 the CPU 81 determines whether removal complete instruction has been acquired. The removal complete instruction is a user's instruction indicating that the user has removed the segmented medium 51 away from the portion between the discharge roller 22 and the counter roller 23. That is, after the user removes the segmented medium 51 from the portion between the discharge roller 22 and the counter roller 23, the user inputs the removal complete instruction into the printer 1 by operating the input portion 4.

When the CPU 81 determines in S41 that the removal complete instruction has not been acquired (S41: NO), the process in 841 is repeatedly executed until the removal complete instruction is inputted. When the CPU 81 determines that the removal complete instruction has been inputted through the input portion 4 (S41: YES), the CPU 81 returns to the process in S21, Accordingly, the CPU 81 cannot receive new print instruction in S21 unless the CPU 81 determines in S41 that the removal complete instruction has been acquired, thereby preventing execution of subsequent print control. After the CPU 81 has acquired the removal complete instruction in S41, the CPU 81 can receive new print instruction in S21, whereby execution of subsequent print control is permitted.

In this way, in a case where the operation mode is set to the second mode in the RAM 84, the CPU 81 determines whether subsequent print control can be permitted based on whether the removal complete instruction has been inputted from the user.

According to the second embodiment, in a case where the medium kind of the medium 5 belongs to the second kind, execution of subsequent print control is not permitted unless the removal complete instruction has been acquired after the current print control is terminated. The user can remove the segmented medium 51 from the portion between the discharge roller 22 and the counter roller 23, and then input the removal complete instruction into the printer 1. Through this operation, the printer 1 can restrain execution of subsequent print control while the segmented medium 51 remains at the portion between the discharge roller 22 and the counter roller 23 Hence, the printer 1 according to the second embodiment can avoid jam of the segmented medium 51 without complexity of the mechanism of the medium detection sensor 99, as similar to the first embodiment.

Figure 8:
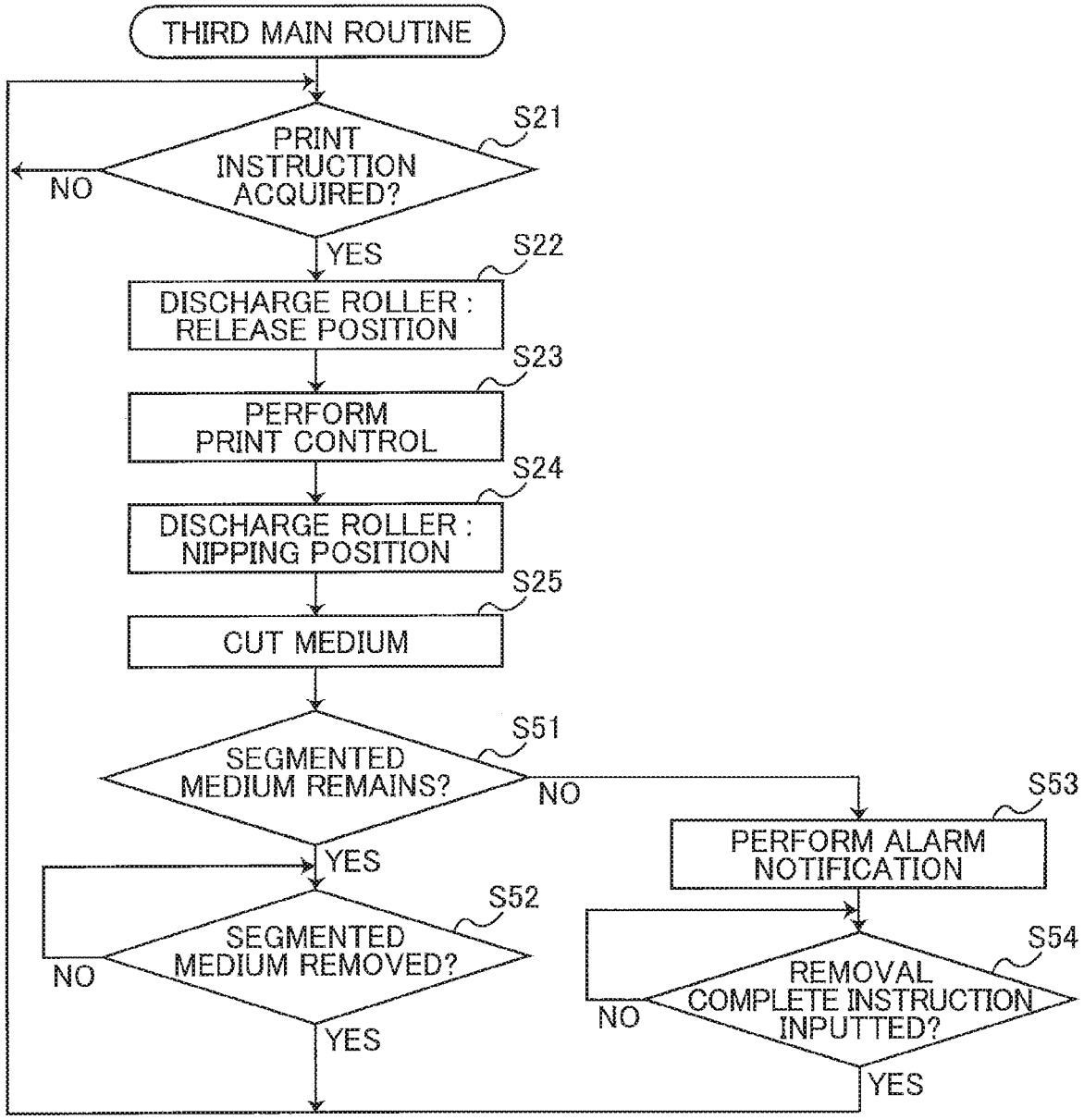
FIG. 8 is a flowchart illustrating a third main routine executed by a CPU in a printer according to a third embodiment.

Next, a printer 1 according to a third embodiment will be described with reference to FIG. 8. Mechanical configuration of the printer 1 according to the third embodiment is the same as those of the first and second embodiments. The third embodiment differs from the first and second embodiments in that a third main routine is executed instead of the first main routine in the first embodiment and the second main routine in the second embodiment. In the third main routine, the CPU 81 does not execute the processes in S11 to S15 executed in the first and second main routines (see FIGS. 6 and 7), and executes the processes subsequent to S25 those are different from the first and second main routines. In FIG. 8, the process the same as those in the first and second embodiments will be designated by the same step numerals as those shown in FIGS. 6 and 7 to avoid duplicating description. As the printer 1 is powered by the user, the CPU 81 expands in the RAM 84 program stored in the flash memory 82 to start the third main routine.

As illustrated in FIG. 8, at the beginning of the third main routine, in S21 the CPU 81 determines whether print instruction has been acquired without executing the processes of S11 through S15 (see FIGS. 6 and 7). After the medium 5 is cut by the cutting blade 12 in S25 to provide a segmented medium 51, in S51 the CPU 81 determines whether the segmented medium 51 is still nipped between the discharge roller 22 and the counter roller 23 on a basis of the detection signal outputted from the medium detection sensor 99. When the CPU 81 determines that the segmented medium 51 is nipped between the discharge roller 22 and the counter roller 23 (S51: YES), the CPU 81 advances to the process in S52.

On the other hand, when the CPU 81 determines in S51 that the segmented medium 51 does not remain at the portion between the discharge roller 22 and the counter roller 23 (S51: NO), the CPU 81 proceeds to the process in S53. As will be described below, the CPU 81 determines whether execution of the subsequent print control is permitted based on whether the segmented medium 51 is determined in S51 to remain at the portion between the discharge roller 22 and the counter roller 23.

In S52 the CPU 81 determines whether the segmented medium 51 which has been nipped between the discharge roller 22 and the counter roller 23 has been removed therefrom on a basis of the detection signal outputted from the medium detection sensor 99. In this way, the CPU 81 can determine whether the user has removed the segmented medium 51 away from the portion between the discharge roller 22 and the counter roller 23.

When the CPU 81 determines that the segmented medium 51 has been removed by the user from the portion between the discharge roller 22 and the counter roller 23 (S52: YES), the CPU 81 returns to the process in S21. In this case, the CPU 81 can receive new print instruction in S21, and hence, execution of subsequent print control is permitted.

On the other hand, when the CPU 81 determines that the segmented medium 51 still remains at the portion between the discharge roller 22 and the counter roller 23 (S52: NO), the CPU 81 waits and repeatedly executes the process in S52 until the segmented medium 51 is removed from the portion between the discharge roller 22 and the counter roller 23 (that is, until OFF signal is outputted from the medium detection sensor 99). At this time, the CPU 81 cannot receive new print instruction in S21, whereby execution of subsequent print control is prevented. In this way, in a case where presence of the segmented medium 51 has been detected through the medium detection sensor 99 in S51, the CPU 81 determines whether to allow execution of subsequent print control on a basis of the detection signal outputted from the medium detection sensor 99.

In S53 the CPU 81 performs alarming notification for prompting the user to input removal complete instruction in order to execute the subsequent print control. In the third embodiment, the CPU 81 performs the alarming notification by controlling the display portion 9 to display an alarm information thereon. As a result, the user can recognize that input of removal complete instruction for enabling execution of subsequent print control is necessary.

Subsequently, in S54 the CPU 81 determines whether the removal complete instruction has been acquired. The CPU 81 returns to the process in S21 when determining in S54 that the removal complete instruction has been acquired through the input portion 4 (S54: YES). In this case, the CPU 81 can receive new print instruction in S21, causing execution of subsequent print control to be allowed.

On the other hand, the CPU 81 waits and repeatedly executes the process in S54 until the removal complete instruction is inputted when the CPU 81 determines that the removal complete instruction has not been acquired (S54: NO). In this case, since the CPU 81 cannot receive new print instruction in S21, execution of subsequent print control is prohibited. In this way, in a case where presence of the segmented medium 51 has not been detected through the medium detection sensor 99 in S51, the CPU 81 determines whether to allow execution of subsequent print control based on Whether the removal complete instruction has been inputted.

According to the third embodiment, when the presence of the provided segmented medium 51 has been detected through the medium detection sensor 99 after the medium 5 has been cut by the cutting blade 12, subsequent print control is not enabled to be executed unless the provided segmented medium 51 has been removed by the user. With this operation, the printer 1 according to the third embodiment can securely prevent subsequent print control from being executed in the state where the segmented medium 51 remains at the portion between the discharge roller 22 and the counter roller 23.

For example, in a case where the medium 5 whose presence or absence is likely to be erroneously detected by the medium detection sensor 99 is used, there is a probability that the provided segmented medium 51 is not detected through the medium detection sensor 99 after the medium 5 has been cut. In this case, subsequent print control is not allowed to be performed unless the removal complete instruction has been acquired. The user is urged to remove the segmented medium 51 from the portion between the discharge roller 22 and the counter roller 23 prior to input of the removal complete instruction. Accordingly, the printer 1 can prevent execution of subsequent print control in the state where the segmented medium 51 remains at the portion between the discharge roller 22 and the counter roller 23.

With the above operation, whichever of the medium 5 of the first kind and the medium 5 of the second kind is used, the printer 1 can securely prevent subsequent print control from being executed while the segmented medium 51 remains at the portion between the discharge roller 22 and the counter roller 23. Hence, jam of the mediums in the printer 1 can be restrained. Therefore, a sensor having a complicated mechanism for detecting the segmented medium 51 whose presence or absence likely to be erroneously detected is not needed. Consequently, the printer 1 can restrain jam of the mediums without employing the medium detection sensor 99 having complicated mechanism.

Figure 9:
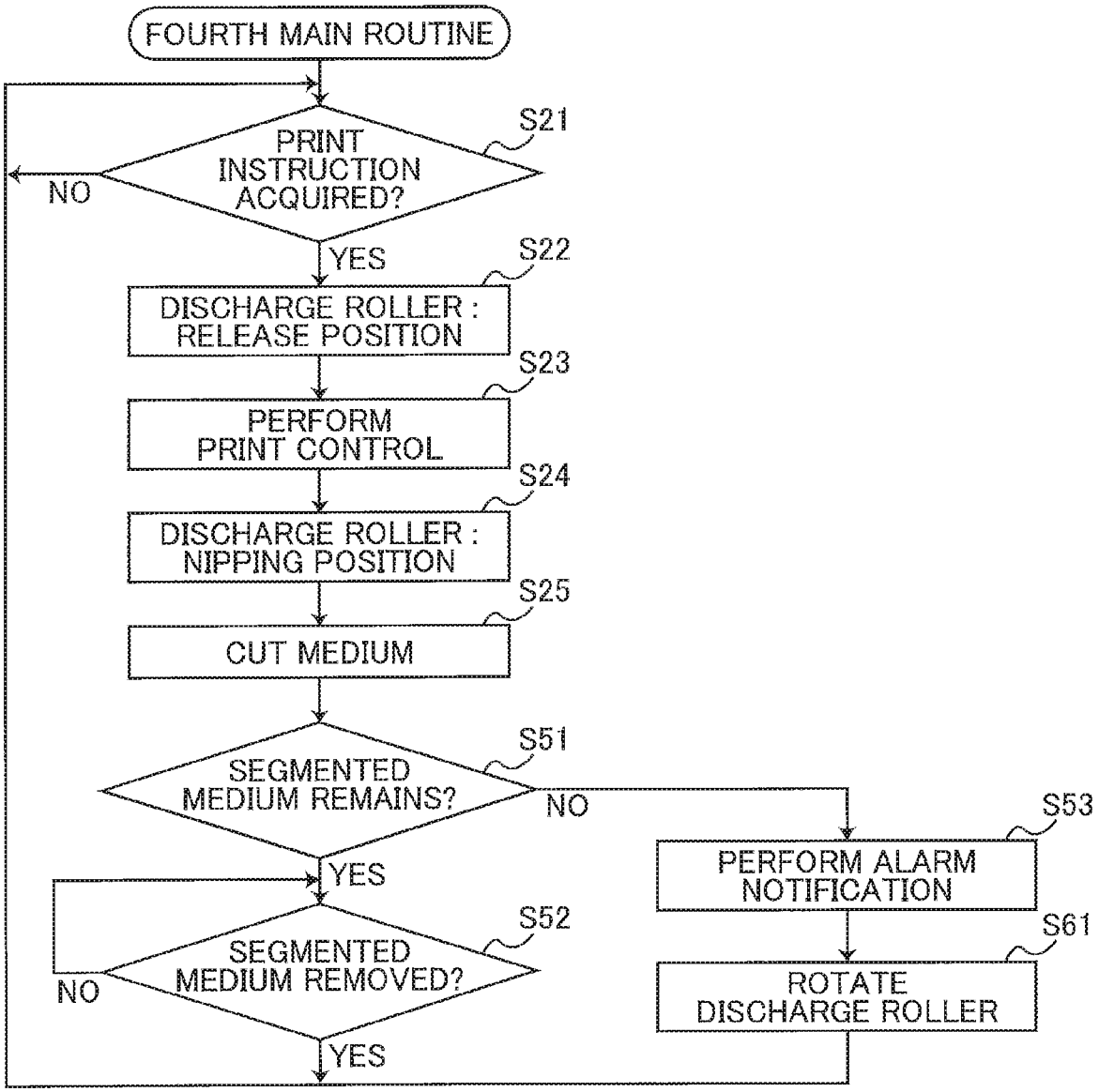
FIG. 9 is a flowchart illustrating a fourth main routine executed by a CPU in a printer according to a fourth embodiment.

A printer 1 according to a fourth embodiment will be described with reference to FIG. 9. Note that mechanical configuration of the printer 1 according to the fourth embodiment is the same as those in the first through third embodiment. The fourth embodiment differs from the first through third embodiments in that a four main routine is executed instead of the first through third main routine in the first through third embodiments. In the fourth main routine, the CPU 81 executes the process in S61 instead of the process in S54 of the third main routine in the third embodiment. In FIG. 9, the process the same as those in the first through third embodiments will be designated by the same step numerals as those shown in FIGS. 6 through 8 in order to avoid duplicating description. When the printer 1 is powered, the CPU 81 expands in the RAM 84 program stored in the flash memory 82 to start the fourth main routine.

As illustrated in FIG. 9, when the CPU 81 determines that a segmented medium 51 does not remain at the portion between the discharge roller 22 and the counter roller 23 (S51: NO), in S53 the CPU 81 performs alarming notification to notify the user that the segmented medium 51 will be automatically discharged from the portion between the discharge roller 22 and the counter roller 23. With this operation, the user can recognize that the user needs to take up the segmented medium 51 to be automatically discharged from the portion between the discharge roller 22 and the counter roller 23.

Then, in S61 the CPU 81 drives the discharge motor 93 to make forward rotation to rotate the discharge roller 22 at the nipping position in the discharging direction, and returns to the process in S21. As a result, the CPU 81 can receive new print instruction in S21, and subsequent print control is allowed to be executed. In other words, the CPU 81 cannot receive new print instruction in S21 unless the discharge roller 22 rotates in the discharging direction in Sol, thereby preventing subsequent print control from being executed. In this way, when determining in S51 that the segmented medium 51 does not remain at the portion between the discharge roller 22 and the counter roller 23, the CPU 81 determines whether the execution of subsequent print control is permitted in response to whether the discharge roller 22 rotates in the discharging direction caused by the forward rotation of the discharge motor 93.

According to the fourth embodiment, when the segmented medium 51 provided by the cutting operation by the cutting blade 12 is not detected, execution of the subsequent print control is prevented unless the discharge roller 22 is rotated in the discharging direction by the forward rotation of the discharge motor 93. Therefore, the printer 1 can securely prevent subsequent print control from being executed in the state where the segmented medium 51 remains at the portion between the discharge roller 22 and the counter roller 23. Consequently, the printer 1 according to the fourth embodiment can restrain jam of the media while avoiding complication in the mechanism of the medium detection sensor 99, as similar to the third embodiment.

While the description has been made in detail with reference to the first through fourth embodiments, it would be apparent to those skilled in the art that various changes and modifications may be made thereto.

For example, according to the first and second embodiments, the CPU 81 performs notification of mode by displaying the set operation mode on the display portion 9. However, the printer 1 may be provided with an LED and/or a speaker so that the CPU 81 can perform notification of mode by flushing on and off the LED and/or outputting sound from the speaker. Further, the CPU 81 may transmit instruction, through a network or a cable, to the external terminal device prompting to perform notification of mode. In this case, the external terminal device performs the notification of mode through a display portion of the external terminal device upon receipt of the instruction from the printer.

Alternatively, the CPU 81 may not execute notification of mode. Further, alarming notification performed in the third and fourth embodiments may be modified in the manner the same as the above notification of mode.

In the first through fourth embodiments, the user inputs print instruction by operating to the external terminal device. In contrast, the print instruction may be inputted into the printer 1 by the user's operation of the input portion 4. Further, in the second and third embodiments, removal complete instruction is inputted into the printer 1 by the user operating the input portion 4. However, removal complete instruction may be inputted into the printer by operating the external terminal device.

The discharge roller 22 at the nipping position may be positioned to face the counter roller 23 with a gap smaller than the thickness of the medium 5. Further, the discharge roller 22 at the release position may be separated from the counter roller 23 with a gap smaller than the thickness of the medium 5 provided that a load applied by the discharge roller 22 to the medium 5 to urge the medium 5 toward the counter roller 23 is smaller than that applied by the discharge roller 22 at the nipping position.

Further, the discharge roller 22 may not be movable between the nipping position and the release position. For example, the discharge roller 22 may be immovably positioned to be in contact with the counter roller 23, or may be immovably positioned to be spaced away from the counter roller 23 with a gap smaller than the thickness of the medium 5. Alternatively, the counter roller 23 may be movable relative to the discharge roller 22. Still alternatively, both the discharge roller 22 and the counter roller 23 may be movable. Further, components for nipping the medium 5 during cutting operation by the cutting blade 12 may be provided in addition to the discharge roller 22 and the counter roller 23.

In the first through fourth embodiments, the counter roller 23 may be a member that is not rotatable, i.e., may not be a roller. In this case, a plate-like member may be employed instead of the counter roller 23. Further, at least one of the discharge roller 22 and the counter roller 23 may be formed of a material other than elastic material. Further, in the second and third embodiments, the discharge roller 22 may be a member that is not rotatable. That is, a plate-like member may be available instead of the roller.

According to the first and second embodiments, when the medium 5 satisfies at least one of the following conditions, the kind of the medium 5 is classified into the second kind: the medium 5 has through-holes; the medium 5 has the width smaller than the prescribed width; the medium 5 has the rigidity smaller than the prescribed rigidity; the medium 5 provides the light transmittance greater than the prescribed level; and the medium 5 provides the refractive index smaller than the prescribed level. In contrast, when the medium 5 satisfies at least two of the above conditions, the kind of the medium 5 may be classified into the second kind. Incidentally, the classification of the medium kind into either one of the first kind and the second kind may be performed depending on other conditions.

According to the first and second embodiments, a transmissive photosensor is used as the medium detection sensor 99, However, a reflective type photosensor, and a mechanical switch are also available as the medium detection sensor 99.

When a reflective type photosensor is employed as the medium detection sensor 99, the kind of the medium 5 may be classified into either one of the first kind and the second kind in accordance with at least one of the following conditions, i.e., presence or absence of through-holes, a width, a rigidity, a light specular reflectance, and a diffuse reflectance.

For example, the kind of the medium 5 that satisfies all of the following conditions, i.e., absence of through-holes, a width equal to or greater than a prescribed width, a rigidity equal to or greater than a prescribed rigidity, a specular reflectance equal to or greater than a prescribed level, and a diffuse reflectance equal to or smaller than the prescribed level may be classified into the first kind, while the kind of the medium 5 satisfying at least one of the following conditions, i.e., presence of through-holes, the width smaller than the prescribed width, the rigidity smaller than the prescribed rigidity, the specular reflectance smaller than the prescribed level, and the diffuse reflectance greater than the prescribed level may be classified into the second kind.

In the latter case, when detection accuracy of the medium 5 subjected to detection by the reflective type photosensor is low, the kind of the medium 5 is classified into the second kind. Accordingly, the printer 1 can avoid erroneous detection of presence or absence of the segmented medium 51 by the medium detection sensor 99. Incidentally, the classification of the medium kind into either one of the first kind and the second kind may be performed in accordance with other conditions.

In a case where a mechanical switch is used as the medium detection sensor 99, the mechanical switch outputs ON signal to the CPU 81 when the segmented medium 51 is in contact with the mechanical switch. The mechanical switch outputs OFF signal to the CPU 81 when the segmented medium 51 is not in contact with the mechanical switch. Hence, the mechanical switch can detect whether there remains the segmented medium 51 nipped between the discharge roller 22 and the counter roller 23.

In this case, the kind of the medium 5 is classified into one of the first kind and the second kind in accordance with at least one of the following conditions: presence or absence of through-holes; a width; and a rigidity. For example, when the medium 5 satisfies all of the following conditions, the medium kind may be classified into the first kind: the medium 5 is not formed with through-holes; the medium 5 has a width equal to or greater than a prescribed width; and the medium 5 has a rigidity equal to or greater than a prescribed rigidity. On the other hand, when the medium 5 satisfies at least one of the following conditions, the medium kind may be classified into the second kind: the medium 5 is formed with through-holes; the medium 5 has the width smaller than the prescribed width; and the medium 5 has the rigidity smaller than the prescribed rigidity.

In the latter case, since the kind of the medium 5 whose presence or absence is likely to erroneously detected by the mechanical switch belongs to the second kind, the printer 1 can restrain jam of the mediums due to erroneous detection of the segmented medium 51 by the medium detection sensor 99. Incidentally, the classification of the medium kind into one of the first kind and the second kind may be performed depending on other conditions.

A recording portion (not illustrated) such as QR code (registered Trademark), bar code, and RF (Radio Frequency) tag may be provided on at least one of the case 70 and the medium 5. For example, in a case where the recording portion is provided at the medium 5, it is preferable that the recording portion is attached to a core (e.g., the first medium spool 41) of the medium 5. The recording portion stores therein information indicative of the medium kind corresponding to the medium 5 accommodated in the case 70, Further, the case 70 may be provided with an identified portion (not illustrated). In this case, the identified portion is in a form of pattern of protrusions or recesses indicative of the medium kind of the medium 5 accommodated in the case 70.

The cassette 7 may be provided with at least one of the recording portion and the identified portion. The printer 1 may be provided with a reading portion (not illustrated) usable for the recording portion and the identified portion. The reading portion reads information indicative of the medium kind from the recording portion and the identified portion, thereby enabling the CPU 81 to acquire the medium kind in S12. In the latter ease, the user's labor of inputting the medium kind into the printer 1 can be saved.

Further, instead of the CPU 81 as the processor, a microcomputer, ASIC (Application Specific Integrated Circuits), and FPGA (Field Programmable Gate Array) are also available. Further, each of the first through fourth main routines may be executed by performing distributed processing using a plurality of processors. Any type of storage media can be employed as the non-transitory storage medium regardless of a period of time during which the medium can store information, as long as the media are capable of storing data. The non-transitory storage medium may not include a transitory storage medium such as a transmitted signal. The program may be downloaded through a server connected to a network, i.e., may be transmitted in the form of transmitted signals, and may be stored in the flash memory 82. In the latter case, the program may be stored in a non-transitory storage medium such as a hard disc provided in the server. Further, the above-described embodiments may be combined together avoiding any technical confliction.

The thermal head 60 is an example of a printing head. The conveyer roller 66 is an example of a conveyer. The cutter blade 12 is an example of a cutter. The discharge roller 22 is an example of the discharge roller. The counter roller 23 is an example of a counter roller. The discharge motor 93 is an example of a driver. The medium detection sensor 99 is an example of the sensor. The CPU 81 is an example of a controller. The CPU 81 that executes the process in S11 is an example of the (a) acquiring. The CPU 81 that executes the process in S13 is an example of the (b) setting. The CPU 81 that executes the process in S14 is an example of the (c)

setting. The CPU 81 that executes the process in S23 is an example of the (d) controlling. The CPU 81 that executes the process in S25 is an example of the (e) controlling. The CPU 81 that executes the process in S32 is an example of the (f) controlling. The CPU 81 that executes the process in S32 to S21 is an example of the (g) permitting. The CPU 81 that executes the process in S33 is an example of the (h) driving. The CPU 81 that executes the process in S33 to S21 is also an example of the (g) permitting. The CPU 81 that executes the process in S41 to S21 is also an example of the (g) permitting. The CPU 81 that executes the process in S23 is an example of the (a) controlling. The CPU 81 that executes the process in S25 is an example of the (b) controlling. The CPU 81 that executes the process in S51 is an example of the (c) controlling. The CPU 81 that executes the process in S52 is an example of the (d) controlling. The CPU 81 that executes the process in S52 to S21 is an example of the (e) permitting. The CPU 81 that executes the process in S54 to S21 is also an example of the (e) permitting. The CPU 81 that executes the process in S61 is an example of the (f) driving. The CPU 81 that executes the process in S61 to S21 is also an example of the (e) permitting. The CPU 81 that executes the process in S32 is an example of the (h) preventing. The CPU 81 that executes the process in S33 is an example of the (i) controlling.

What is claimed is:

1. A printer comprising:

a printing head configured to perform printing on a medium;

a conveyor configured to convey the medium in a conveying direction;

a cutter positioned downstream of the printing head and the conveyor in the conveying direction, the cutter being configured to cut the medium to provide a segmented medium;

a discharge roller positioned downstream of the cutter in the conveying direction;

a counter roller positioned to face the discharge roller and configured to nip the medium in cooperation with the discharge roller;

a sensor positioned downstream of the cutter in the conveying direction, the sensor being configured to detect whether the segmented medium remains at a portion between the discharge roller and the counter roller; and a controller configured to perform:

(a) acquiring information indicative of kind of the medium, the kind of medium being classified into either one of a first kind and a second kind;

(b) setting, when the kind of the medium acquired in the (a) acquiring is the first kind, an operation mode to a first mode;

(c) setting, when the kind of the medium acquired in the (a) acquiring is the second kind, the operation mode to a second mode;

(d) controlling, when a first print instruction has been acquired, the printing head and the conveyor to perform a first print control on the medium, the first print control being first performed based on the acquired first print instruction to perform printing on the medium;

(e) controlling, after completion of the (d) controlling, the cutter to cut the medium;

(f) controlling the sensor to detect whether the segmented medium has been removed from the portion between the discharge roller and the counter roller; and (g) permitting a second print control to be performed, the second print control being performed subsequent to the first print control based on a second print instruction acquired subsequent to the first print instruction to perform printing on the medium, wherein, when the operation mode is set to the first mode in the (b) setting, the controller performs the (g) permitting after performing the (f) controlling, and wherein, when the operation mode is set to the second mode in the (c) setting, the controller performs the (g) permitting without performing the (f) controlling.

2. The printer according to claim 1, further comprising a driver configured to drivingly rotate the discharge roller in a discharging direction, rotation of the discharge roller in the discharging direction causing the segmented medium to be conveyed downstream in the conveying direction, wherein, when the operation mode is set to the first mode in the (b) setting, the controller performs the (g) permitting when the sensor detects in the (f) controlling that the segmented medium has been removed from the portion between the discharge roller and the counter roller, wherein, when the operation mode is set to the second mode in the (e) setting, the controller is configured to further perform:

(h) driving the driver to drivingly rotate the discharge roller in the discharging direction; and the (g) permitting after performing the (h) driving.

3. The printer according to claim 1, wherein, when the operation mode is set to the first mode in the (b) setting, the controller performs the (g) permitting when the sensor detects in the (f) controlling that the segmented medium has been removed from the portion between the discharge roller and the counter roller, and wherein, when the operation mode is set to the second mode in the (c) setting, the controller performs the (g) permitting after an instruction inputted by a user has been acquired.

4. The printer according to claim 1, further comprising a reading unit configured to read the information indicative of the kind of the medium from information storing unit provided at least one of the medium and a cassette including the medium, wherein the (a) acquiring acquires the information indicative of the kind of the medium through the reading unit.

5. The printer according to claim 1, further comprising a receiving unit configured to receive input of information indicative of the kind of the medium by the user, wherein the (a) acquiring acquires the information indicative of the kind of the medium through the receiving unit.

6. The printer according to claim 1, wherein the sensor is a transmissive photosensor, and wherein the medium of the second kind has at least one of characteristics including:

a through-hole;

a width smaller than a prescribed width;

a rigidity smaller than a prescribed rigidity;

a light transmittance greater than a prescribed level; and a refractive index smaller than a prescribed level.

7. The printer according to claim 1, wherein the sensor is a reflective type photosensor, and wherein the medium of the second kind has at least one of characteristics including:

a through-hole;

a width smaller than a prescribed width;

a rigidity smaller than a prescribed rigidity;

a light specular reflectance smaller than a prescribed level; and a light diffuse reflectance greater than a prescribed level.

8. The printer according to claim 1, wherein the sensor is a mechanical switch, and wherein the medium of the second kind has at least one of characteristics including:

a through-hole;

a width smaller than a prescribed width; and a rigidity smaller than a prescribed rigidity.

9. A printer comprising:

a printing head configured to perform printing on a medium;

a platen roller configured to nip the medium in cooperation with the printing head;

a cutter positioned downstream of the printing head and the platen roller in a conveying direction in which the medium is conveyed, the cutter being configured to cut the medium to provide a segmented medium;

a discharge roller positioned downstream of the cutter in the conveying direction;

a counter roller positioned to face the discharge roller and configured to nip the medium in cooperation with the discharge roller;

a sensor positioned downstream of the discharge roller and the counter roller in the conveying direction, the sensor being configured to detect whether the segmented medium remains at a portion between the discharge roller and the counter roller; and a controller configured to perform:

(a) acquiring information indicative of kind of the medium, the kind of medium being classified into either one of a first kind and a second kind;

(b) setting, when the kind of the medium acquired in the (a) acquiring is the first kind, an operation mode to a first mode;

(c) setting, when the kind of the medium acquired in the (a) acquiring is the second kind, the operation mode to a second mode;

(d) controlling, when a first print instruction has been acquired, the printing head and the platen roller to perform printing on the medium based on the acquired first print instruction;

(e) controlling, after completion of the (d) controlling, the cutter to cut the medium;

(f) controlling the sensor to detect whether the segmented medium has been removed from the portion between the discharge roller and the counter roller;

(g) permitting, when the sensor detects in the (f) controlling that the segmented medium has been removed from the portion between the discharge roller and the counter roller, a second print instruction to be received, the second print instruction being acquired subsequent to the first print instruction to perform printing on the medium; and (h) preventing, when the sensor detects in the (f) controlling that the segmented medium remains at the portion between the discharge roller and the counter roller, the second print instruction from being received, and wherein, when the operation mode is set to the first mode in the (b) setting, the controller performs:

the (g) permitting when the sensor detects in the (f) controlling that the segmented medium has been removed from the portion between the discharge roller and the counter roller; and the (h) preventing when the sensor detects in the (f) controlling that the segmented medium remains at the portion between the discharge roller and the counter roller, and wherein, when the operation mode is set to the second mode in the (c) setting, the controller performs:

(i) controlling the discharge roller to be rotated in the discharging direction; and the (g) permitting without executing the (f) controlling, the (g) permitting being performed after the (i) controlling is performed.

* * * * *